United States Patent [19]

Powis, Jr.

[11] 4,454,401

[45] Jun. 12, 1984

[54] SAFETY EXTENSION LEVER FOR WALL SWITCH

[76] Inventor: George S. Powis, Jr., 153 Green St., Lansdale, Pa. 19446

[21] Appl. No.: 416,914

[22] Filed: Sep. 13, 1982

[51] Int. Cl.[3] ..... H01H 15/24

[52] U.S. Cl. ..... 200/331

[58] Field of Search ..... 200/331, 330, 338

[56] References Cited

U.S. PATENT DOCUMENTS

| | | | |
|---|---|---|---|
| 2,493,581 | 1/1950 | Hood | 200/331 X |
| 3,004,128 | 10/1961 | Mikolajeski | 200/331 |
| 3,188,439 | 6/1965 | Fullerton | 200/331 |
| 3,839,615 | 10/1974 | Bradford | 200/331 |
| 3,892,935 | 7/1975 | Patterson | 200/331 |

*Primary Examiner*—John W. Shepperd
*Assistant Examiner*—Renee S. Kidorf
*Attorney, Agent, or Firm*—B. Max Klevit

[57] ABSTRACT

A modified wall plate for a standard toggle switch outlet is equipped with an arm or lever adapted to slide on the plate. The arm or lever is provided with a hollowed protuberance extending outwardly from the front face of the arm and arranged to receive and enclose the actuating finger of a standard toggle switch when the modified wall plate is attached at an existing wall outlet for the switch. The arm or lever is equipped with a detachable rod extending to a substantial distance below the bottom of the wall plate to a level within reach of a small child, thus enabled to safely operate the switch.

5 Claims, 2 Drawing Figures

SAFETY EXTENSION LEVER FOR WALL SWITCH

The present invention is concerned with electrical wall switch installations, more particularly with such switches of the toggle type.

BACKGROUND OF THE INVENTION

Electrical wall switches, such as those of the toggle type, are conventionally installed at a height convenient for manipulation by adults and older children. Small children, unable to reach the switch, are tempted at times to get up on a stool, chair or any available means enabling them to reach the switch, which may provide an infirm support or otherwise subject the child to a hazard of slipping or falling with consequent injury.

Familiar wall switches and particularly those used in dwellings, comprise a switch box or housing fixedly mounted in a hollow provided in the wall. The switch, generally of the single pole toggle type, is attached to the box by upper and lower screws inserted through holes in a mounting plate at the front of the switch, with the mounting plate being generally substantially flush with the wall surface. Equidistant from the top and bottom switch-mounting screws, the mounting plate is further provided with threaded holes, conventionally at centers two and three-eighths inches ($2\frac{3}{8}$ in.=6.0325 cm.) apart, to receive screws by which the wall plate is attached to the mounting plate of the switch, thus covering the hollow opening in the wall. The operating finger for actuating the switch to ON and OFF positions projects through a central vertical slot in the wall plate.

SUMMARY OF THE INVENTION

Among the objects of the present invention is to provide an easily installed extension lever for attachment to a wall switch, such that the switch can be safely and conveniently operated by small children.

The device of the present invention comprises a modified wall plate attachable to a conventional existing toggle switch, the modified plate having an actuating arm or lever slidably mounted on said wall plate, said arm or lever being provided with an outwardly extending hollow protuberance engaging and enclosing the operating finger of the switch and extending for a desired substantial distance below the bottom edge of the wall plate.

The operation of the invention will be understood and its several advantages appreciated from the detailed description which follows read in connection with the accompanying drawings illustrating a preferred embodiment of the device.

DETAILED DESCRIPTION

Figure 1:
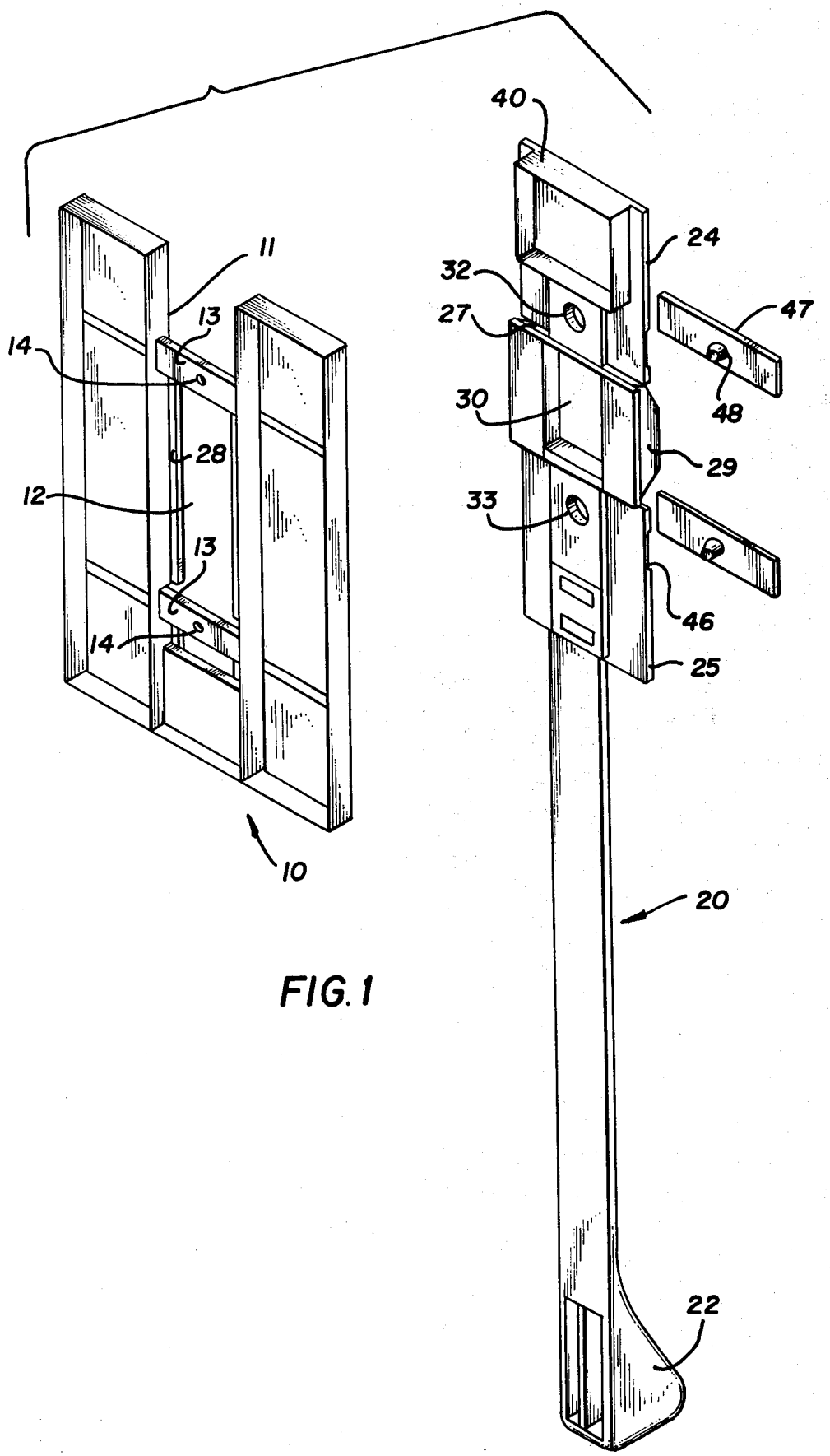
FIG. 1 is a disassembled isometric view as seen from the rear of the device.
Figure 2:
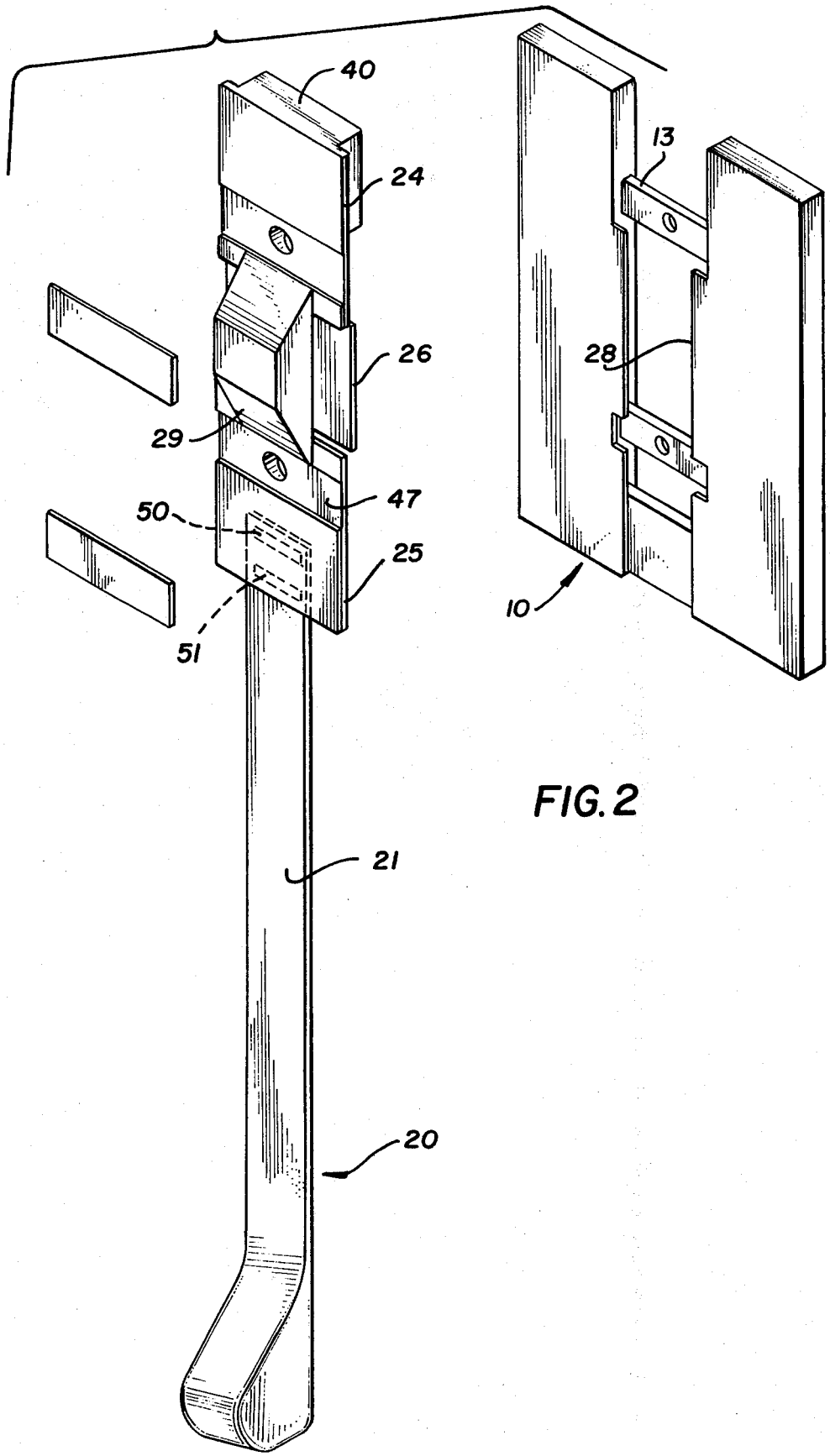
FIG. 2 is a similar view as seen from the front of the device.

The illustrated modified wall plate 10 is attachable by screws to the familiar electric switch outlet in the same manner as the conventional wall plate, being substantially of the same outer dimensions. Plate 10 is notched from the top down to form a vertical slot 11 extending to a distance short of the bottom of the plate 10, thus providing a U-shaped frame. Slot 11 is traversed by two cross bars 13, 13, at equal distances respectively from the top and bottom of wall plate 10. There is thus formed between the upper and lower cross bars 13, a vertical window 12 substantially at the center of plate 10. The cross bars 13 are each provided with a screw hole 14 through which a standard headed screw may be inserted and threaded into the conventional threaded holes provided in the standard toggle switch. Thus mounted, the operating finger of the standard toggle switch will project through window 12 of wall plate 10.

A switch actuating arm or lever 20 is provided to be slidably mounted for vertical reciprocal movement in slot 11 of the wall plate 10. Element 20 includes an extended rod portion 21 projecting a desired distance below the bottom edge of wall plate 10 when the arm 20 is assebled in operating position within slot 11. Rod portion 21 terminates at its lower extremity in an outwardly extending knob-like protuberance providing a finger grip portion 22.

At its upper end portion arm 20 is widened to provide vertically spaced apart slide plates 24, 25, each of said slide plates being slightly wider than slot 11, so that when arm 20 is mounted in slot 11 the outer edges of the side plates will overlap the edges of the slot while sliding over the front face of plate 10.

Intermediate plates 24 and 25 a slide plate 26 is provided on the rear face of arm 20. Plate 26 is offset rearwardly from plates 24 and 25, thus providing a narrow space 27 between the rear faces of plates 24 and 25 and the opposed face of plate 26 at its upper and lower edges.

Extending inwardly from the vertical sides at the front face of window 12 are narrow fins 28 serving as a pair of tracks on the inner face of which slide plate 26 rides during upward and downward movement of arm 20 in slot 11. Thus, in assembled condition when slide plate 26 abuts the fins 28 and at least a portion of plate 24 abuts the front face of plate 10, the arm 20 is locked against being pulled away from wall plate 10.

Between plates 24 and 25, including the region in front of plate 26, there is provided a nose-like protuberance 29 extending outwardly from arm 20, said protuberance being hollowed at its upper portion through plate 26 to provide a cavity 30, and adapted to fit over and enclose the projecting finger lever of the conventional toggle switch when the assembly constituted by plate 10 and arm 20 are mounted on the wall outlet to replace the conventional wall plate.

In operative condition with the assembled device 10, 20, attached to the wall switch outlet and the finger lever of the toggle switch housed within the cavity 30 while said finger is in the DOWN position (usually, but not necessarily in the OFF position), the top edge of arm 20 will be substantially flush with the top edge of wall plate 10. In this position a circular opening 32 provided through plate 24 will coincide with and overlie upper screw hole 14 in upper cross bar 13. Similarly, opening 33 through plate 25 will coincide with and overlie screw hole 14 in lower cross bar 13.

To attach arm 20 to the wall plate 10, the arm is placed within slot 11 with plates 24 and 25 in raised position, the bottom edge of plate 25 at a position just below the top edge of wall plate 10 and the side edges of arm 20 resting on the outer surface of the wall plate. By moving arm 20 downwardly within slot 11, slide plate 26 moves through slot 11 and on further downward movement of arm 20 the outwardly-facing surface of plate 26 slides over the parallel tracks formed by fins 28, thus locking the arm within wall plate 10 against removal from the plate.

The desired terminal position for downward movement of the arm 20 within the wall plate 10 is when the upper edge of plate 24 is substantially flush with the upper edge of wall plate 10 and the holes 32 and 33 are aligned respectively with the upper and lower holes 14 in the respective cross bars 13.

Extending upwardly from the inner face of arm 20 at the top thereof, a rectangular boss 40 is provided of a width to fit loosely within the upper portion of slot 11 at the widest part of the slot and of a length such that the lower edge of the boss will rest on upper cross bar 13 to limit downward movement of arm 20 in slot 11 at the desired point, providing access to screw holes 14 through the circular openings 32 and 33.

To install the device of the invention at an existing wall switch outlet, the conventional wall plate is removed by unscrewing the two screws which hold the plate attached to the switch mounting plate. With arm 20 slidably mounted in wall plate 10 in the manner hereinabove described and the openings 32 and 33 alined with upper and lower screw holes 13, the device is placed over the switch outlet with openings 32 and 33 alined with the threaded holes of the switch mounting plate. Openings 32 and 33 are of a diameter greater than that of the heads of the attaching screws so that these screws inserted through openings 32 and 33 have their shoulders abutting against the faces of cross arms 13 when the original attaching screws (or replacements of these) are threaded into the switch mounting plate. In this manner the device of the invention becomes firmly attached to the wall outlet with the finger lever of the toggle switch encase in cavity 30 of the nose-like protuberance 29. The switch may now be actuated to ON and OFF positions respectively by upward and downward movement of the extension rod 21.

While unnecessary for practical operation of the device, it may be desired for aesthetic purposes to conceal the circular openings 32, 33, when the device has been attached at the wall outlet. This may be accomplished as shown in the drawings, for example, by recessing the front faces of plates 24 and 25 adjacent openings 32 and 33, to accommodate a covering. Thus, as shown, recesses 45 and 46 are formed in plates 24 and 25 respectively, to accomodate fitted fillets 47 (only one being shown in the drawings) inserted into the recesses so that the upper surfaces of the fillets are substantially flush with the outer surfaces of plates 24 and 25. Fillets 47 are provided with pegs 48 tightly fitting within the openings 32, 33, enabling removal of the fillets for access to openings 32 and 33 for detachment of the device from the wall outlet.

An added feature of the present device is the removability of the extension 21 when there is no further need or desire for its utilization for actuation of the wall switch. For this purpose, as shown, rod 21 is fitted into a recess provided in lower slide plate 25 so that it may be removed from such recess only after detachment of the device from the wall outlet. Rod 21 is held on plate 25 by interfitted frictionally engaged lug and recess members in the opposed faces of the rod and the plate such as indicated at 50 and 51, such that rod 21 may be lifted up and detached from plate 25. The reassembled device, with plates 24, 25, 26, slidably mounted in wall plate 10, can then be reattached to the wall outlet in the same manner as previously described. Following such reattachment of the device with the rod 21 removed, the switch can be readily actuated to ON and OFF positions by grasping and manipulating the protuberance 29.

While metals could be employed, if desired, in fashioning either or both the wall plate 10 and arm 20, for reasons of safety as well as economics, it is preferred to make these out of a moldable plastic, particularly one adapted to injection molding, and which sets to a hard rigid structure of desired mechanical strength. Commercially available plastic compositions that can be employed in the manufacture of the device of the present invention will be apparent to those skilled in the art pertaining to the formation of rigid plastics for various industrial uses. Examples of such plastics include phenolic resins and highly polymerized amino plastics, with preference being had for polypropylene in the production of the devices of the present invention.

What is claimed:

1. A device for operation of an electric wall switch of the toggle type, comprising: a modified wall plate attachable to an existing toggle switch outlet, said modified plate having an actuating arm or lever slidably mounted within the plate, said arm or lever being provided with an outwardly extending hollow protuberance adapted to overlie and enclose within said hollow the actuating finger of a toggle switch extending outwardly from a wall, said arm or lever having a rod member extending for a desired substantial distance below the bottom edge of the wall plate; said modified wall plate comprising a U-shaped frame formed by upstanding arms and a base forming a vertical slot, upper and lower horizontal cross bars traversing said slot and forming a window frame, narrow fins extending inwardly of said window frame at the front face of said modified wall plate; said arm or lever having an intermediate slide plate abutting said hollow protuberance and arranged to slide on the inner surface of said fins, said arm or lever further having upper and lower slide plates respectively above and below said intermediate slide plate and spaced outwardly therefrom, said intermediate slide plate being on the rear face of said actuating arm and said upper and lower slide plates being on the front face of said arm thereby providing a narrow space between the rear faces of said upper and lower slide plates and the opposed face of said intermediate slide plate at the upper and lower edges of said intermediate slide plate, whereby said upper and lower slide plates are adapted to ride on the outer surface of said modified wall plate during sliding of said arm or lever in the vertical slot.

2. A device as defined in claim 1 wherein said upper and lower cross bars are spaced to aline with the screw threaded holes in the switch mounting plate of a standard toggle switch and screw receiving holes are provided in said cross bars for reception of headed screws enabling attachment of said modified wall plate to the switch mounting plate of a standard toggle switch.

3. A device as defined in claim 2 wherein said upper and lower slide plates on said arm or lever are provided with circular openings through which headed attaching screws can be passed for engagement into the screw receiving holes of the cross bars.

4. A device as defined in claim 2 wherein said upper and lower slide plates are recessed in the area of said circular openings and are further provided with fillets removably fitted into said recessed area and covering said circular openings.

5. A device as defined in claim 1 wherein said upper slide plate is provided with an inwardly extending rectangular boss, adapted to contact said upper cross bar to limit downward movement of said arm or lever.

* * * * *